US005171182A

United States Patent [19]

Heinen

[11] Patent Number: 5,171,182

[45] Date of Patent: Dec. 15, 1992

[54] CAMISOLE BRASSIERE

[75] Inventor: Valerie L. Heinen, West Hempstead, N.Y.

[73] Assignee: Wacoalamerica, Inc., New York, N.Y.

[21] Appl. No.: 861,074

[22] Filed: Mar. 31, 1992

[51] Int. Cl.[5] ..... A41C 3/10; A41C 3/12

[52] U.S. Cl. ..... 450/74; 450/44; 450/45; 450/47; 450/49; 450/51; 450/52; 450/65; 450/75; 450/76; 450/86; 2/67; 2/73

[58] Field of Search ..... 2/67, 73; 450/1, 41, 450/43, 44, 45, 46, 47, 49, 51, 52, 53, 65, 66, 67, 70, 74, 75, 76, 77, 86

[56] References Cited

U.S. PATENT DOCUMENTS

| | | | |
|---|---|---|---|
| Re. 19,960 | 5/1936 | Clancy | 450/36 |
| 2,115,398 | 4/1938 | Rosenthal | 450/86 X |
| 2,130,534 | 9/1938 | Bowen | 450/86 |
| 2,245,413 | 6/1941 | Pilot | 450/86 |
| 2,380,978 | 8/1945 | Licht | 450/52 |
| 2,457,928 | 1/1949 | Silva | 450/86 |
| 2,462,987 | 3/1949 | Michaelson | 450/86 |
| 2,586,267 | 2/1952 | Schaumer | 450/70 |
| 2,594,549 | 4/1952 | Flores et al. | 450/86 X |
| 2,691,166 | 10/1954 | Roth | 450/74 |
| 2,794,984 | 6/1957 | Astor | 450/52 |
| 3,078,851 | 2/1963 | Sachs | 450/86 X |
| 3,120,848 | 2/1964 | Seperack | 450/86 |
| 3,172,408 | 3/1965 | Sachs et al. | 450/74 X |
| 3,304,940 | 2/1967 | Hölscher | 450/86 X |
| 3,320,959 | 5/1967 | Fridolph | 450/86 X |
| 3,372,698 | 12/1968 | Gingras | 450/86 X |
| 3,528,430 | 9/1970 | Child | 450/52 |

*Primary Examiner*—Werner H. Schroeder
*Assistant Examiner*—Jeanette E. Chapman
*Attorney, Agent, or Firm*—Abelman Frayne & Schwab

[57] ABSTRACT

A garment having the combined appearance of a brassiere and a camisole is provided with a camisole top, the brassiere function of the garment being provided by non-stretchable shoulder straps that extend across the interior of the breast cups, and, which are securely connected with the brassiere frames, the shoulder straps extending on a diagonal of the breast cups, portions of the breast cups being reinforced to provide for the support of the weight of the breast.

6 Claims, 2 Drawing Sheets

CAMISOLE BRASSIERE

FIELD OF THE INVENTION

This invention relates to a brassiere construction by means of which a simulation of a top of a camisole garment is obtainable, thus to provide the soft, delicate and appealing appearance of a camisole, while at the same time, providing support and control for the female breasts.

BACKGROUND OF THE INVENTION

Brassieres of themselves are well-known, as are camisoles, each of which is designed to specific requirements, and, each of Which has requirements that are specific to that particular garment, and, which in no way relate to the other of those garments.

In view of the totally different requirements in the construction of the respective garments, it hitherto has been found to be impossible to provide an operative combination of a brassiere and a camisole, despite the desirability of providing such a garment, the requirements of the respective garments being disparate and directly opposed to one another.

On the one hand, a brassiere is intended to confine, support and hold the female breasts, and, to exert control over the movement of the breasts resulting from movements of the torso.

On the other hand, a camisole is in no way encumbered with those requirements, but instead, is required to provide a soft, gentle, and entirely natural appearance, that is essentially free-moving on the torso, and, which in no way exerts confining or molding forces, or support for the weight of the breasts, or, control over movement of the breasts.

The disparate requirements of the respective garments have resulted in a requirement to employ both such garments simultaneously with one another. This, however, then result in the combined garments being overly heat-retaining and bulky, both of which conditions are to be avoided if at all possible in that they can cause discomfort to the wearer.

SUMMARY OF THE INVENTION

According to the present invention, a very specific construction of brassiere is provided, that will exert confining forces, support and movement control over the breasts, while at the same time providing for the support and lateral stretching of a conventional camisole top, thus combining both garments into a single garment, and in so doing avoiding the weight penalty, added heat-retention and possible discomfort of two such garments when worn in conjunction one with the other.

The garment of the present invention includes a pair of substantially rigid arcuate frames that are interconnected by a gusset panel formed of a flexible material that is resistant to stretching both in vertical and horizontal directions, thus to provide a soft and flattering interconnection between the frames at the cleavage.

Attached to the frontal surface of both of the frames are breast cups formed integrally one with the other by a flexible frontal panel of the garment The frontal panel preferably is formed from a lace-like material that has controlled stretchability in a horizontal direction, and has substantially zero stretchability in a vertical direction, such characteristics readily being provided by a lacy material that has been machine-knit on a Raschel machine.

The frontal panel itself is inoperative to provide the required control, molding and support of the breasts, and, in fact acts dominantly in the decorative capacity of a camisole top of lace-like material.

Secured to each of the frames at the opposite sides thereof is one-half of an elastic waist band that is provided with fastener members at its ends, thus enabling the frames and the front panel to be attached to the wearer's torso with the elastic straps arranged in encircling relation with the user's torso.

Connected to each of the elastic straps is a non-stretchable shoulder strap, the shoulder straps optionally including a minor extent of elastic material in order to accommodate upwards movement of the associated shoulder the wearer.

The non-stretchable shoulder straps then extend downwardly in convergent relationship and substantially diagonally within the breast cups, and, are attached at their lower ends directly to the associated frame. The shoulder straps thus define two sides of a triangle that has its apex positioned beneath the gusset panel, the gusset panel and the frame members thus providing a non-stretchable interconnection between the ends of the respective shoulder straps.

Secured to the shoulder straps on the outer side of the triangle defined by those shoulder straps, and confined within each of the breast cups provided by the frontal panel, is a reinforcing control panel formed of a material having controlled stretchability in a horizontal direction, and substantially zero stretchability in a vertical direction, the reinforcing control panels preferably being formed of a substantially transparent gauze-like material, preferably one that has been knit on a Tricot machine, the panel being oriented for minimum stretchability in the vertical direction and maximum stretchability in the horizontal direction.

Interconnecting the shoulder straps and the elastic waist band are transitional elastic straps to which both the frontal panel and the reinforcing control panel are connected, thus to transmit a horizontal stretching force to the front panel, that is effective to maintain the upper edge of the frontal panel slightly stretched across the wearer's upper chest, again, in a manner simulating that of a camisole.

By this construction, movement control of the wearer's breasts is provided by the elastic waist band and the breast cups provided by the frontal panel. Molding is provided the reinforcing control panels, and, support is provided by the non-stretchable shoulder straps, thus to provide an integral garment, the upper portion of which simulates a camisole, which, at the same time, exhibits the required desirable characteristics of a brassiere.

DESCRIPTION OF THE DRAWINGS

The invention will now be described with reference to the accompanying drawing, in which.

DESCRIPTION OF THE PREFERRED EMBODIMENT

Figure 1:
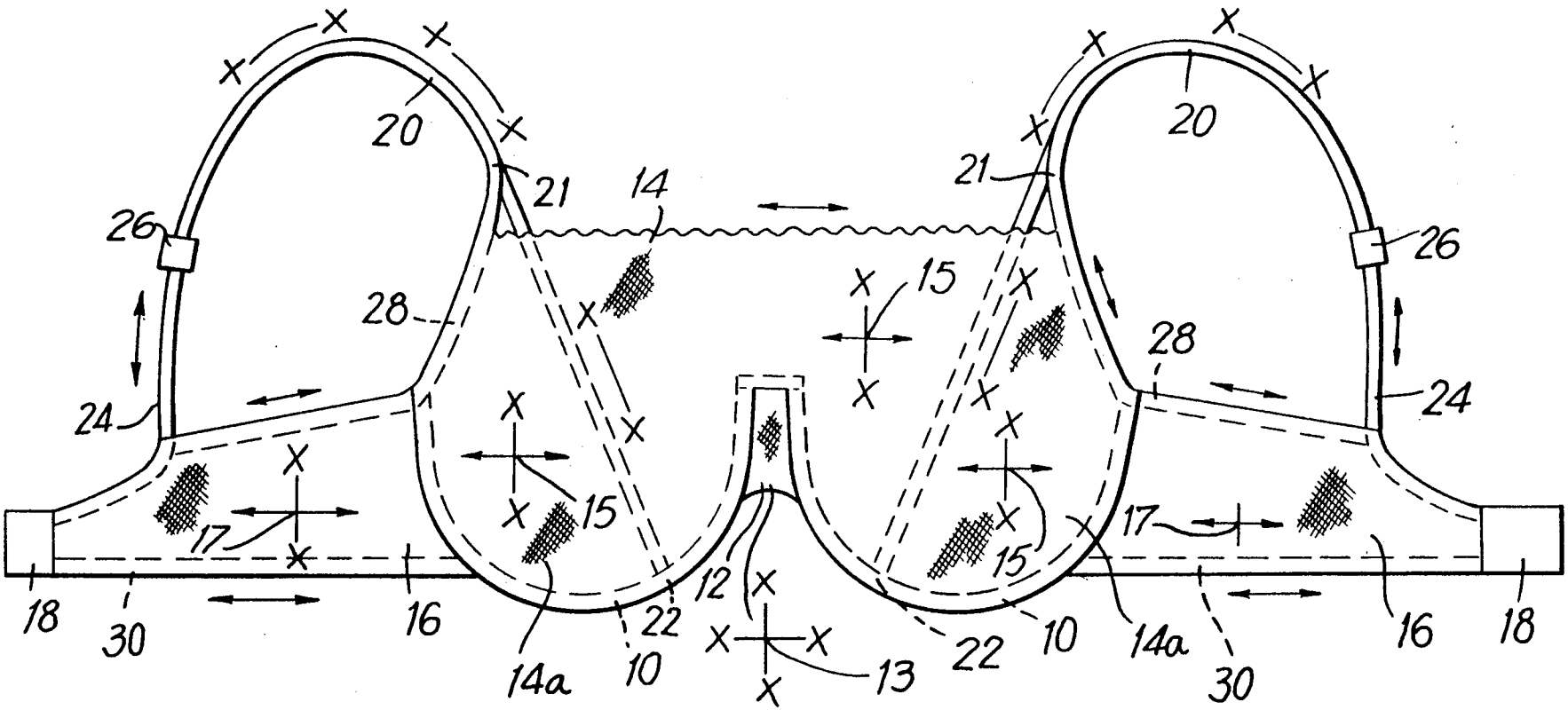
FIG. 1 is a representation of the front surface of the garment.

A typical garment according to the present invention comprises frames 10, which can be of any conventional construction or material, usually a stiff but pliable plastics material. At the adjacent ends of the frame members 10, those members are interconnected by a gusset panel 12, which is formed from a flexible material having considerable resistance to stretching both in a vertical direction and in a horizontal direction, thus providing a strong, but extremely flexible tie between the respective frames 10.

To assist in understanding the inventive concept of the present invention, indicia are provided showing the directions of either non-stretchability, or, stretchability of the several integers of the garment, x—x being an indication that a particular element of the garment is non-stretchable in that direction, oppositely facing arrows indicating directions of controlled stretchability within the garment. For example, and with respect to the gusset panel 12, the directions of non-stretchability have been indicated by the crucifer x—x and x—x diagram 13.

The gusset panel 12, and its interconnection with the frames 10, is operative to control shifting of the respective frames 10 relative to each other in vertical directions, thus stabilizing the positions of the frames 10, while, at the same time, permitting limited shifting of the frames relative to each other in vertical directions, such as will be caused by movements of the wearer's shoulders.

The frames 10 are sewn into a frontal panel 14 in a conventional manner, such that a strong interconnection between the frame 10 and the front panel is provided. The frontal panel 14 is selectively cut and sewn for it to provide the usual breast cups, the frontal panel 14 being flanked by panel portions **14*a*** to provide the required breast cup configuration.

The frontal panel 14, and also the side panels **14*a* each are formed of a material that is non-stretchable in a vertical direction, and, which has controlled stretchability in horizontal directions, as indicated by the diagrams 15**.

The respective frames 10 then are connected to torso straps 16 which terminate in fasteners 18 of any known construction, such as hook and eyelets, buttons, Velcro [registered trademark] or the like. As is indicated by the diagrams 17, the respective torso straps 16 each are non-stretchable in a vertical direction, and, have controlled stretchability in horizontal directions.

Traversing the frontal panels 14, and sewn into the frontal panel 14 on the rear face thereof are shoulder straps 20 formed from an axially non-stretchable material, the shoulder straps being securely affixed to the respective frames 10 at the positions indicated at 22.

To permit adjustability of the length of the shoulder straps 20, preferably a relatively short portion of the shoulder straps is comprised of a length 24 of an elastic material, which is adjustably attached to the adjacent end of the strap 20 by means of a conventional bottle indicated at 26. The elastic shoulder strap portions 24 then are securely sewn into an upper edge portion of the associated torso strap 16, the upper edge of the torso strap having an edge binding of an elastic material, shown at 28, which continues throughout the length of the torso strap 16, and which then progresses upwardly and is sewn into the side edges of the frontal panel 14, the elastic edge bindings 28 each then continuing upwardly to a point at which they are sewn directly into the non-stretchable shoulder straps 20, as is indicated at 21.

The lower edges of the torso straps 16 similarly are provided with an edge binding 30 of an elastic material, which is attached at one of its ends to the associated frame 10, and which is attached at its other end to the associated end connector 18.

Figure 2:
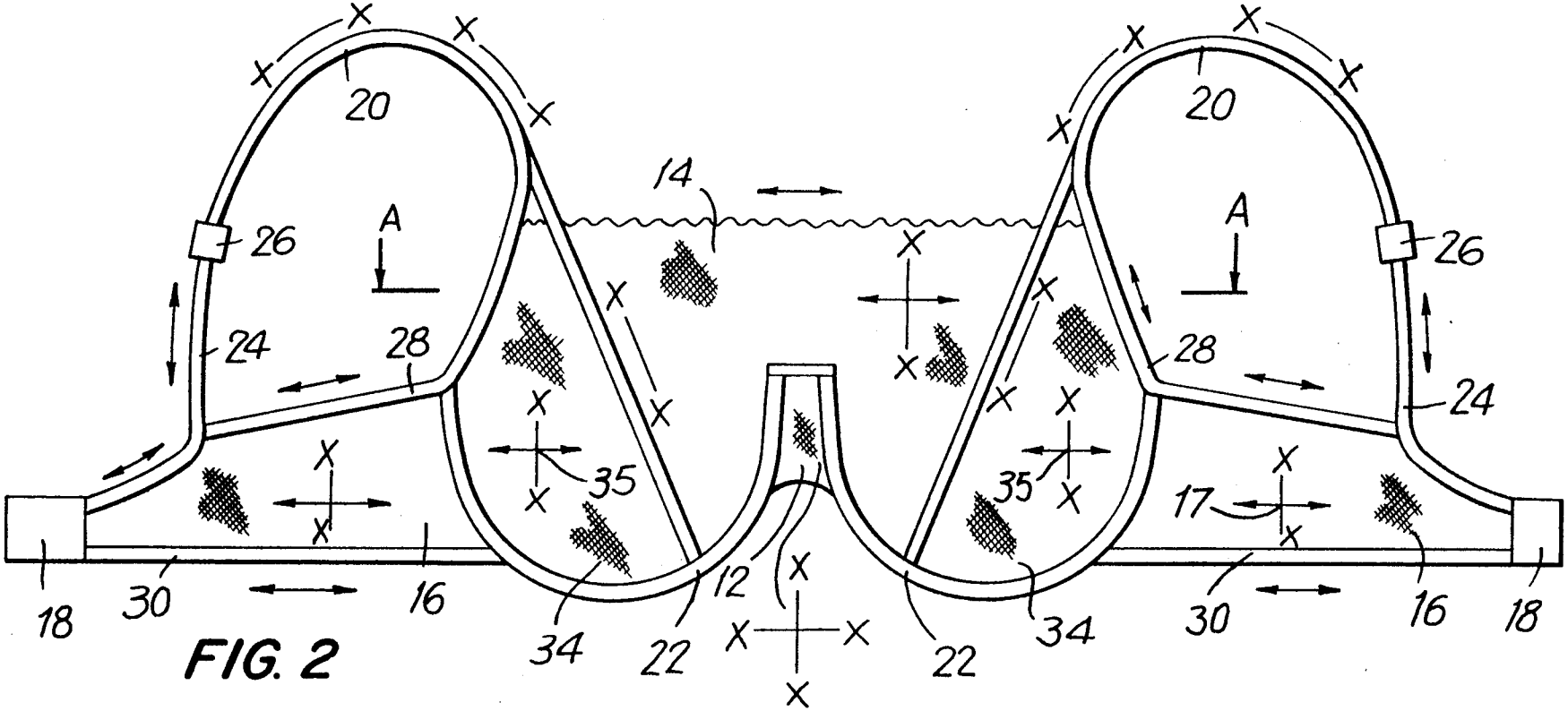
FIG. 2 is a representation of the rear surface of the garment.
Figure 3:
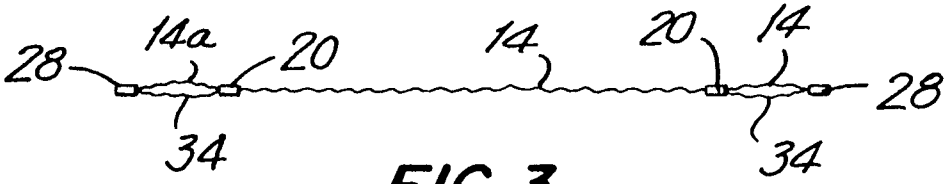
FIG. 3 is a cross-section taken on the line A—A in FIG. 2.

The description so far provided is directly related to FIG. 1, which shows the frontal aspect of the garment, and which, because it is obscured from view in FIG. 1, does not show reinforcement panels that are co-extensive with the respective frontal panel portions **14*a*, and, which are positioned behind the respective frontal panel portions 14*a*, those reinforcement panels being shown at 34 in FIG. 2. The reinforcement panels 34 are co-extensive with the frontal panels 14*a*, and thus, are integrated into the respective breast cups, the respective reinforcement panels 34 also being securely sewn into the non-stretchable shoulder straps 20**.

Those portions of the shoulder straps 20 that traverse the breast cups have the same axial length as the length on that diagonal of the contoured breast cup, the diagonal length of the shoulder straps having been carefully sewn within the frontal panel 14, in order to provide minimum discomfort to the wearer.

The reinforcement panels 34, as indicated by the diagrams 35, also are non-stretchable in the vertical direction, and are of controlled stretchability in the horizontal direction. In this manner, the frontal panel portions **14*a* and their lining provided by the reinforcement panels 34, in combination with the frames 10 and the elastic binding 28 provide portions of the respective breast cups that are of sufficient strength and resistance to horizontal stretching for them to support substantially the entire weight of the contained breast, and, additionally, provide for control of the movement of the respective breasts in lateral directions relative to the torso, the respective breast cups being interconnected one with the other by the gusset panel 12** in a manner that inhibits movement of the respective breasts relative to each other in lateral directions.

This support of the weight of the breasts, as assisted by adjustment of the length of the elastic straps 24 is operative to provide an uplifting of the breasts, and, the movement of breast tissue in excess of the volumetric capacity of the laterally outer reinforced portions of the breast cups, upwardly and towards the vertical center line of the brassiere, thus to provide a flattering packing of the frontal panel 14, the frontal panel 14, itself being held in a stretched condition by the forces exerted thereon by the elastic edge bindings 28.

Various materials ca be employed in the fabrication of the garment as choice dictates. For example, the frontal panel 14, the frontal panel portions **14*a*, and the torso straps 16 each can be fabricated from a lace-like material that has been machine-woven on a Raschel machine, such lace-like fabrics exhibiting a high resistance to stretchability in the longitudinal direction, and, controlled stretchability in the lateral direction. The reinforcement panels 34** preferably are fabricated from a gauzy material of low weight and high transparency that has been machine-formed on a Tricot knitting machine, such materials similarly being essentially non-stretchable in the longitudinal direction, and, having controlled stretchability in lateral directions. Various other materials can be incorporated into the construction to inhibit or control stretchability in specific directions, for example, by the addition of lines of lock stitch incorporated into the garment, and, by the judicious choice of the characteristics of the bias bindings employed in the construction of the garment. Also, the seam stitching can be effected with appropriate materials and in appropriate stitching patterns, that again either will inhibit stretchability, or, permit stretchability along the seaming lines.

What is claimed is:

1. A combined brassiere and camisole garment, comprising:

dual breast frames formed from a material that is stiff and relatively inflexible in the general plane of said respective breast frames;

a flexible gusset panel interconnecting one side of each of said respective breast frames, said gusset panel being formed from a material that is non-stretchable in both vertical and horizontal directions;

breast cups attached to said respective breast frames and said gusset panel, said breast cups being formed from a frontal panel of said garment that extends between opposite sides of said respective breast frames, and which provides a simulation of a camisole top, said frontal panel being non-stretchable in a vertical direction, and being of controlled stretchability in a horizontal direction;

a torso strap connected to each said opposite side of each said breast frame, said torso straps having connecting means at their free ends for connecting said free ends one to the other, said torso straps being formed from a material that is non-stretchable in a vertical direction, and which has controlled stretchability in a horizontal direction;

a shoulder strap extending interiorly of each said breast cup and fixedly attached to the associated said breast frame at one end of said shoulder strap, the other end of said shoulder strap being fixedly attached to the torso strap associated with the said associated breast frame, said shoulder straps being formed from a material which is non-stretchable in a direction extending longitudinally thereof; and, a reinforcement panel incorporated into each said breast cup and extending between the associated said shoulder strap and the said opposite side of each said breast frame;

the arrangement being such that said breast frames, torso straps, shoulder straps and reinforcement panels, in the wearing of said garment, provide for support of the weight of a breast, and also provided control over lateral movements of said breasts, said frontal panel being movable relative to the wearer's breasts, thus to simulate a camisole top.

2. The garment of claim 1, in which said shoulder straps, in the wearing of said garment, extend over the wearer's shoulders and then downwardly over an associated one of the user's breast, said shoulder straps being arranged in downwardly extending diagonally convergent relationship.

3. The garment of claim 1, in which said associated breast cups, reinforcement panels and said shoulder straps are secured to each other by sewing.

4. The garment of claim 1, in which said shoulder straps incorporate a minor length of an elastic material.

5. The garment of claim 4, in which said shoulder straps and said elastic portions are adjustably interconnected with each other by adjustable securing means.

6. The garment of claim 1, including edge bindings on selected parts of said garment of an elastic material operative to increase the resistance to stretching of the associated portion of the garment.

* * * * *